US006587028B2

(12) United States Patent
Mollet et al.

(10) Patent No.: US 6,587,028 B2
(45) Date of Patent: Jul. 1, 2003

(54) FUSED DISCONNECT SWITCH

(75) Inventors: Ronald Emil Mollet, Ellisville, MO (US); Brian Corey Hall, St. Peters, MO (US)

(73) Assignee: Cooper Technologies Company, Houston, TX (US)

( * ) Notice: Subject to any disclaimer, the term of this patent is extended or adjusted under 35 U.S.C. 154(b) by 6 days.

(21) Appl. No.: 09/897,682

(22) Filed: Jul. 2, 2001

(65) Prior Publication Data

US 2002/0080005 A1 Jun. 27, 2002

Related U.S. Application Data

(60) Provisional application No. 60/216,575, filed on Jul. 7, 2000.

(51) Int. Cl.[7] ..... H01H 85/044; H01H 85/25; H01H 85/48

(52) U.S. Cl. ..... 337/194; 337/186; 337/208; 337/4; 361/104; 361/642

(58) Field of Search ..... 337/255, 1, 4, 337/5, 9, 142, 186, 194, 208, 241, 242, 245, 265, 266, 206; 361/642, 646, 833, 835, 837, 626, 104

(56) References Cited

U.S. PATENT DOCUMENTS

| | | | | | |
|---|---|---|---|---|---|
| 1,966,716 | A | * | 7/1934 | Green | 337/188 |
| 3,030,474 | A | * | 4/1962 | Scott, Jr. | 337/146 |
| 3,358,100 | A | * | 12/1967 | Schleicher | 337/194 |
| 3,379,842 | A | * | 4/1968 | Downs et al. | 337/146 |
| 3,432,789 | A | * | 3/1969 | Poehlman, Jr. | 337/186 |
| 4,394,602 | A | * | 7/1983 | Apgar et al. | 174/92 |
| 5,355,274 | A | * | 10/1994 | Marach et al. | 361/103 |
| D367,041 | S | * | 2/1996 | Alfaro et al. | D13/160 |
| 5,559,662 | A | * | 9/1996 | Happ et al. | 337/265 |
| 5,739,737 | A | | 4/1998 | Hatton | |
| 5,841,337 | A | | 11/1998 | Douglass | |
| 5,963,411 | A | * | 10/1999 | Mollet et al. | 337/213 |
| 5,973,418 | A | * | 10/1999 | Ciesielka et al. | 307/112 |
| 6,317,312 | B1 | * | 11/2001 | Hashizawa et al. | 337/194 |
| 6,327,140 | B1 | * | 12/2001 | Hashizawa et al. | 337/194 |
| 6,333,845 | B1 | * | 12/2001 | Hashizawa et al. | 337/194 |
| 2002/0047770 | A1 | * | 4/2002 | Scoggin et al. | 337/167 |
| 2002/0064013 | A1 | * | 5/2002 | Milanczak | 361/104 |
| 2002/0067279 | A1 | * | 6/2002 | Torrez et al. | 340/638 |

FOREIGN PATENT DOCUMENTS

DE 2902051 A * 7/1980 ..... H01H/21/16

OTHER PUBLICATIONS

Nov. 23, 2001, Search Report Under Section 17, (1 p.).

* cited by examiner

*Primary Examiner*—Anatoly Vortman
(74) *Attorney, Agent, or Firm*—Armstrong Teasdale LLP

(57) ABSTRACT

A fused disconnect switch assembly includes a switch housing assembly and a pull out fuse assembly. The switch housing assembly includes a housing defining a fuse receptacle, first and second terminal contacts within the housing and located adjacent the fuse receptacle, and an alarm terminal extending from the fuse receptacle to an exterior of the fuse housing. The pull out fuse assembly includes a housing, a line side terminal extending from the housing, a load side terminal extending from the housing, and a primary fuse having first and second conductive end caps. The fuse end caps are coupled to respective line side and load side terminals of the pull out fuse assembly housing, and the first and second terminal contacts of the switch housing assembly receive the load side and the line side terminal blades of the pull out fuse assembly.

18 Claims, 4 Drawing Sheets

FUSED DISCONNECT SWITCH

CROSS REFERENCE TO RELATED APPLICATIONS

This application claims the benefit of U.S. Provisional Application No. 60/216,575, filed Jul. 7, 2000.

BACKGROUND OF THE INVENTION

This invention relates generally to disconnect switches, and, more particularly, to fused disconnect switches.

Fuses are widely used as overcurrent protection devices to prevent costly damage to electrical circuits. Fuse terminals typically form an electrical connection between an electrical power source and an electrical component or a combination of components arranged in an electrical circuit. One or more fusible links or elements, or a fuse element assembly, is connected between the fuse terminals, so that when electrical current through the fuse exceeds a predetermined limit, the fusible elements melt and opens one or more circuits through the fuse to prevent electrical component damage.

In some applications, fuses are employed not only to provide fused electrical connections but also for connection and disconnection, or switching, purposes to complete or break an electrical connection or connections. As such, an electrical circuit is completed or broken through conductive portions of the fuse, thereby energizing or de-energizing the associated circuitry. Typically, the fuse is housed in a fuse holder having terminals that are electrically coupled to desired circuitry. When conductive portions of the fuse, such as fuse blades, terminals, or ferrules, are engaged to the fuse holder terminals, an electrical circuit is completed through the fuse, and when conductive portions of the fuse are disengaged from the fuse holder terminals, the electrical circuit through the fuse is broken. Therefore, by inserting and removing the fuse to and from the fuse holder terminals, a fused disconnect switch is realized.

Known fused disconnect switches of this type, however, are disadvantaged in certain applications. For instance, in telecommunications applications, increasing power demands of equipment loads have rendered many fused disconnect switches inadequate. More specifically, known fused disconnect switches having adequate ratings (e.g., capable or interrupting 20 kA at 80 VDC) are relatively large and difficult to mount in telecommunication panel system, and ganging conventional disconnect switches on a common input bus in a telecommunications system is difficult, if not impossible Still further, especially when a large number of disconnect switches are employed, quick and accurate identification of opened fuses is necessary so that opened fuses may be identified and replaced. Conventional fused state identification mechanisms are not as reliable as desired for telecommunications applications.

For at least the above reasons, use of known fused disconnect switches have not completely met the needs of certain end applications, such as use in telecommunications systems.

BRIEF SUMMARY OF THE INVENTION

In an exemplary embodiment, a fused disconnect switch assembly includes a switch housing assembly and a pull out fuse assembly. The switch housing assembly includes a housing defining a fuse receptacle, first and second terminal contacts within the housing and located adjacent the fuse receptacle, and an alarm terminal extending from the fuse receptacle to an exterior of the fuse housing. The pull out fuse assembly includes a housing, a line side terminal extending from the housing, a load side terminal extending from the housing, and a primary fuse having first and second conductive end caps. The fuse end caps are coupled to respective line side and load side terminals of the pull out fuse assembly housing, and the first and second terminal contacts of the switch housing assembly receive the load side and the line side terminal blades of the pull out fuse assembly. An electrical connection is therefore established between the fuse assembly and the switch housing assembly when the fuse assembly is inserted into the fuse receptacle of the switch housing assembly, and the electrical connection is broken, as desired, by removing the fuse assembly from the fuse receptacle of the switch housing assembly.

More specifically, the fuse assembly includes a fuse terminal assembly having upper and lower fuse brackets. A primary fuse and a secondary indication fuse are coupled to the fuse brackets and mounted in parallel therebetween. Line side and load side terminals extend from the respective fuse brackets for connection to terminal contacts in the switch housing assembly. The secondary fuse includes a fuse indicator cap that completes an electrical connection with a first lead of an LED mounted in the housing when the primary fuse is opened. A second lead of the LED is coupled to a fuse alarm terminal, also mounted in the fuse assembly housing. The fuse alarm terminal is accessible through an opening in the fuse assembly housing, and the alarm terminal of the switch housing assembly engages the fuse alarm terminal when the fuse assembly is inserted into the fuse receptacle. Local fuse state indication is therefore provided with the LED in the fuse assembly housing, and remote fuse state identification is facilitated with a signal transmitted through the fuse alarm terminal and the switch housing assembly alarm terminal. When the primary fuse is opened, the LED is illuminated and an alarm signal is transmitted through the alarm terminals.

The switch assembly housing, in one embodiment, includes a groove in one side to facilitate panel mounting, and a threaded nut on the other side to secure the switch assembly housing to the panel when the groove is engaged to an edge of a panel cutout. Thus, panel mounting of the fused disconnect switch is not only facilitated but simplified for relatively quick and easy installation in the field. In a further embodiment, at least one terminal extends from the switch assembly housing and includes a threaded nut for mounting to a common bus connection with a fastener. Moreover, the fused disconnect switch housing is sized and dimensioned to permit multiple fused disconnects switches to be ganged together and mounted to a common bus bar.

A fused disconnect switch is therefore provided that is advantageous for use, in for, example, paneled telecommunications systems.

DETAILED DESCRIPTION OF THE INVENTION

Figure 1:
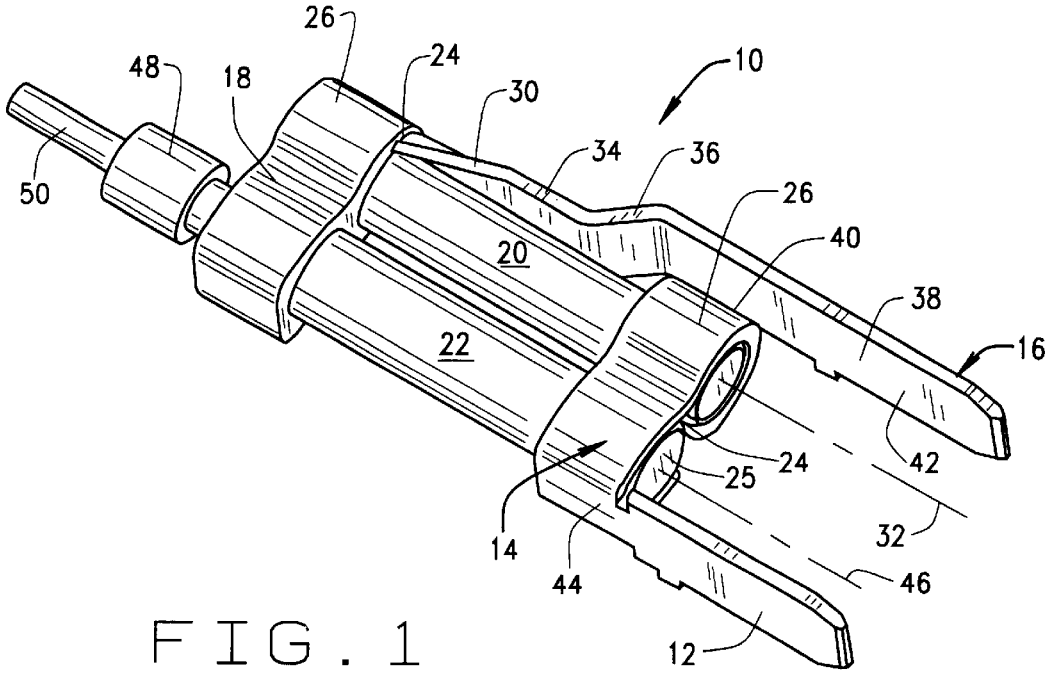
FIG. 1 is perspective view of a fuse terminal assembly.

FIG. 1 is plan view of a fuse terminal assembly 10 including a load side terminal blade 12 extending from a lower fuse bracket 14 and a line side terminal blade 16 extending from an upper fuse bracket 18. Terminal blades 12, 16 and fuse brackets 14, 18 are integrally formed and fabricated from an electrically conductive material so as to establish an electrical connection through a primary fuse 20 and a secondary fuse 22 for fuse state indication. Primary fuse 20 and secondary fuse 22 extend between upper and lower fuse brackets 14, 18 and are mounted in parallel between terminal blades 12, 16. Fuse brackets 14, 18 are formed to receive cylindrical conductive end caps 24 of primary fuse 20 and conductive end caps 25 of secondary fuse state indicator 22. Secondary fuse 22 has a much higher electrical resistance than primary fuse 20 so that when line side and load side blade terminals 16, 12, respectively, are connected to an electrical circuit (not shown) substantially all of the current flowing through fuse terminal assembly 10 passes through primary fuse 20. The primary fuse side of each fuse bracket 14, 18 includes a spring clip 26 to ensure secure electrical connection to primary fuse 20.

In an illustrative embodiment, line side terminal blade 16 extends from upper bracket 18 and is deflected outwardly away from primary fuse 20 and extends longitudinally beyond lower fuse bracket 14. More specifically, line side terminal blade 16 includes a first lateral section 30 extending laterally away from, i.e., obliquely to, a longitudinal axis 32 of primary fuse 20, a second parallel section 34 extending substantially parallel to primary fuse longitudinal axis 32, a second lateral section 36 extending laterally away from primary fuse longitudinal axis 32, and a parallel terminal portion 38 extending substantially parallel to primary fuse longitudinal axis 32. As such, lateral sections 30, 36 extend terminal portion laterally away from primary fuse longitudinal axis 32 to provide a sufficient clearance between a lateral edge 40 of lower fuse spring clip 26 and an inner surface 42 of line side blade terminal portion 38 to prevent direct electrical connection between terminal blade portion 38 and lower fuse spring clip 26 that could short circuit primary fuse 20.

In addition, load side terminal blade 12, in one embodiment, extends longitudinally from a lateral edge 44 of lower bracket 14 in a substantially parallel fashion to a longitudinal axis 46 of secondary fuse 22. In a further embodiment, longitudinal axes 32, 46 of primary fuse 20 and secondary fuse 22 are substantially parallel to one another. It is contemplated, however, that other configurations of terminal blades 12, 16, brackets 14, 18, and orientation of fuses 20, 22 may be employed in alternative embodiments without departing from the scope of the present invention.

In one embodiment, soldering (not shown) is employed according to known methods and techniques to further establish and maintain electrical connection with primary fuse 20 and/or secondary fuse 22. More specifically, in a particular embodiment, a 40% tin and 60% lead solder is applied to establish electrical connection between fuses 20, 22 and fuse brackets 14, 18. It is contemplated, however, that adequate electrical connection between fuses 20, 22 and fuse brackets 14, 18 may be accomplished in alternative embodiments without soldering the respective connections A substantially cylindrical fuse indicator cap 48 is electrically connected to one end cap (not shown in FIG. 1) of secondary fuse 22 located within upper fuse bracket 18. A longitudinal pin 50 extends from fuse indicator cap 48 to facilitate local and remote fuse state indication, as further described below.

Primary fuse 20 includes a fuse link or fuse element (not shown) extending between fuse end caps 24 that is shaped and dimensioned to melt, vaporize, disintegrate or otherwise open and break an electrical connection through primary fuse 20 when current therethrough approaches a pre-selected level dependant upon fuse element characteristics. When primary fuse 20 opens, components and circuits (not shown) coupled to load side terminal blade 12 are isolated and protected from damaging fault currents. In one embodiment, primary fuse 20 is a high performance, 0.25 inch by 1.25 inch fuse having a fuse rating of 3A to 30A and configured to interrupt 20 kA at 80 VDC. As such, fuse assembly 10 is particularly suited for telecommunications applications.

Secondary fuse 22 has a much greater electrical resistance than primary fuse 20 such that substantially all of the current flowing through fuse terminal assembly 10 flows from line side terminal 16 through primary fuse 20 and to load side terminal 12 during normal use of fuse terminal assembly 10. In different embodiments, secondary fuse 22 has equal or unequal fuse ratings as that of primary fuse 20.

It is anticipated that fuses of different ratings than those described above could be employed to achieve the benefits of the invention in other desired applications and for other purposes than the above-described telecommunications application. Accordingly, the embodiment described and illustrated herein is for exemplary purposes only, and the invention is in no way directed to a specific end-use application.

Figure 2:
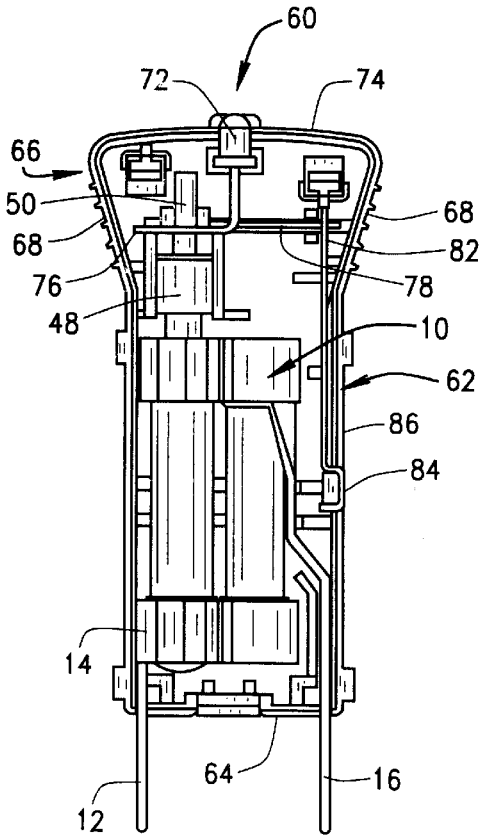
FIG. 2 is a front elevational view of a fuse assembly including the terminal assembly shown in FIG. 1.

FIG. 2 is a front elevational view of a fuse assembly 60 including fuse terminal assembly 10 located within a fuse housing 62 with line side terminal blade 16 and load side terminal blade 12 extending through a bottom portion 64 of fuse housing 62. In one embodiment, fuse housing 62 is fabricated from a nonconductive material, such as plastic, and includes a widened head portion 66 including textured sides 68 for gripping by a user to connect or disconnect fuse terminal blades 12, 16 from an electrical circuit (not shown). In one embodiment, housing 62 is a two-piece, snap together assembly (illustrated in FIG. 2 with one piece removed) that is securely fastened about fuse terminal assembly 10 and enclosing internal components thereof. In alternative embodiments, other mechanical attachment mechanisms, including but not limited to welded connections and rivets, are employed, and in further alternative embodiments, housing constructions having different numbers of pieces are employed without departing from the scope of the present invention.

An LED 72 is mounted within fuse housing head portion 66 and protrudes through a top 74 of fuse housing 62 for local indication of an opened fuse condition. An electrical lead 76 extends below LED 72 within fuse housing 62 and is positioned in proximity to, but separated from, fuse state indicator cap 48. When fuse assembly 10 is connected to an electrical circuit (not shown) via fuse terminal blades 12, 16 and a fault condition occurs, primary fuse 20 opens and breaks an electrical connection through primary fuse 20. The fault current then passes through secondary fuse 22, causing fuse 22 to open and break an electrical connection through fuse terminal blades 12, 16, and also causing fuse indicator cap 48 to be forced upward, placing fuse indicator cap 48 in electrical contact with LED lead 76 and energizing LED 72. In one embodiment, indicator cap 48 is spring-biased and held in contact with LED lead 76 to maintain illumination of LED 72 with line voltage to indicate the open fuse condition. As electrical paths to lower bracket 14 through fuses 20, 22 is broken, load side terminal is isolated from line side currents, thereby protecting load side equipment, components and circuits from damaging currents.

In an alternative embodiment, mechanical local fuse state indication is employed in lieu of LED 72, such as, for example, attaching a brightly colored sleeve (not shown) to indicator cap pin 50 and arranging fuse indicator cap 48 so that pin 50 extends through top 74 of housing 62 when primary fuse 22 has opened.

An LED alarm lead 78 also extends below LED 72 in fuse housing 62 and is coupled to an alarm terminal 82 situated in fuse housing 62 adjacent fuse assembly 10. Alarm terminal 82 includes a remote alarm contact portion 84 exposed through a side wall 86 of fuse housing 62 to provide remote fuse state indication, as described further below.

When used in conjunction with an appropriate housing assembly, such as those described below, fuse assembly 60 is particularly suited for switching purposes in, for example, telecommunications applications.

Figure 3:
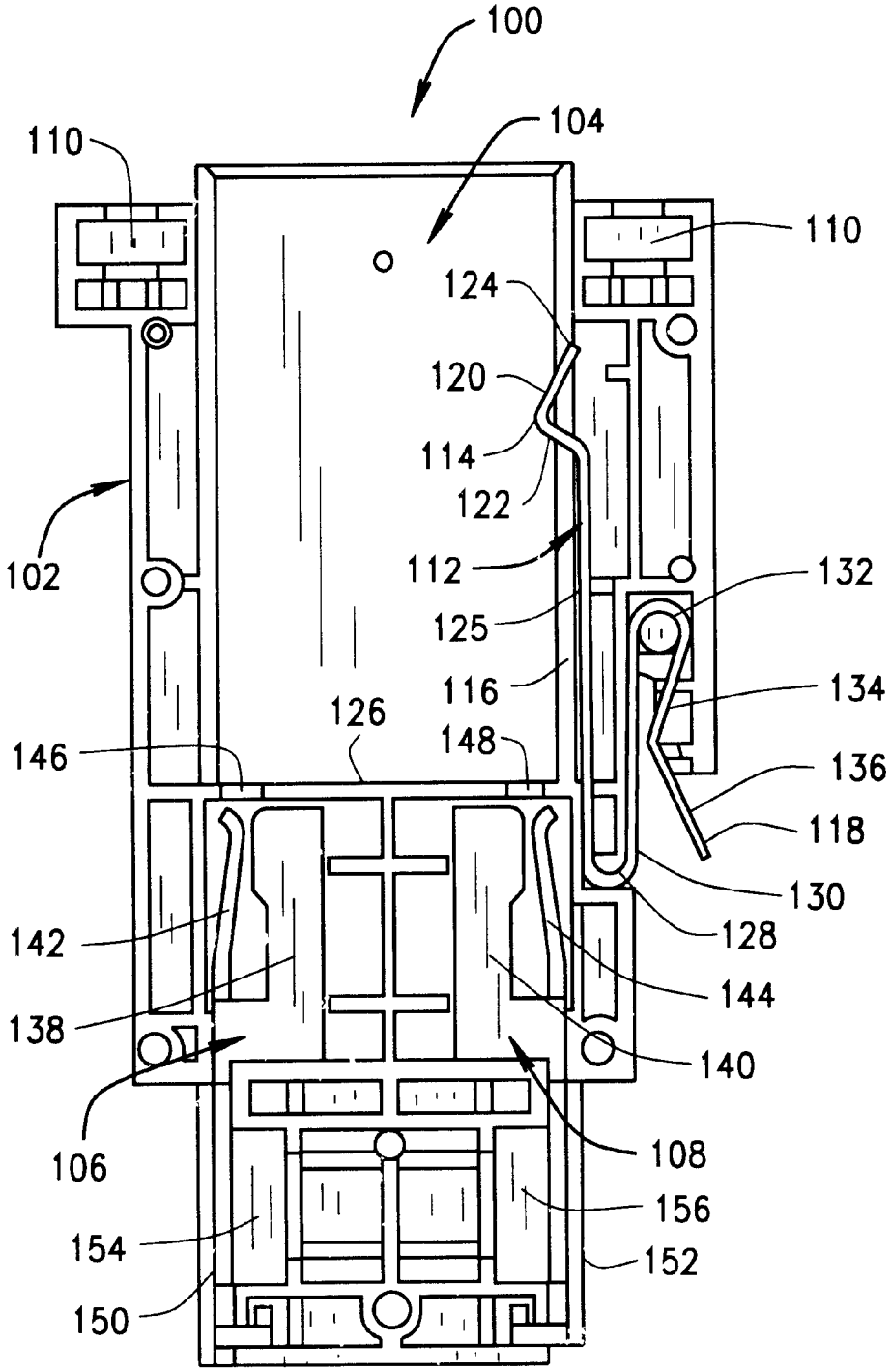
FIG. 3 is a plan view of a switch housing for use with the fuse assembly shown in FIG. 2.

FIG. 3 is a plan view of a switch housing assembly 100 for use with fuse assembly 60 (shown in FIG. 2), and including a non-conductive housing 102 forming a fuse receptacle 104, and a line contact 108 and a load contact 106 below fuse receptacle 104 for receiving fuse assembly blade terminals 12, 16 (shown in FIGS. 1 and 2) when fuse housing 62 (shown in FIG. 2) is inserted into fuse receptacle 104. In one embodiment, switch housing 102 is fabricated from a nonconductive material, such as plastic, and is a two-piece assembly (illustrated in FIG. 3 with one piece removed) that is securely fastened together to enclosed internal components thereof. In various alternative embodiments, mechanical attachment mechanisms, including but not limited to snap together constructions, welded connections and rivets are employed, and in further alternative embodiments, housing constructions having different numbers of pieces are employed.

Switch housing 102 further includes threaded nuts 110 adjacent fuse receptacle 104 for receiving screws (not shown) for panel mounting of switch housing 102. Using a threaded nut 110, switch housing 102 may be mounted with line contact 108 in electrical communication with a common input bus bar (not shown), and a plurality of switch housings 102 may be mounted side-by-side to provide a plurality of fused switch connections. In an exemplary embodiment, housing 102 is dimensioned for installation into a 1 $\mu$ (1.75 inch/44.5 mm) panel familiar to those in the art.

A remote alarm terminal 112 is located adjacent fuse receptacle 104 and includes a projecting ridge 114 extending through a side wall 116 of fuse receptacle 104 for engagement with fuse assembly alarm terminal 82 (shown in FIG. 2), and specifically with contact portion 84 (shown in FIG. 2) when fuse assembly 60 (shown in FIG. 2) is fully inserted into fuse receptacle 104. Remote alarm terminal 112 also extends external to switch housing 102 at an end 118 opposite projecting ridge 114. Alarm terminal end 118 may be coupled to, for example, a resistive load, such as a relay coil (not shown) typically found in existing telecommunications equipment, thereby transmitting an alarm signal to an external system to facilitate remote fuse state indication. In an alternative embodiment, end 118 is coupled to a common alarm bus bar (not shown).

In an illustrative embodiment, alarm terminal 112 includes at least several distinct portions internal and external to housing 102. Projecting ridge 114 is defined by first and second ridge portions 120, 122 extending obliquely to fuse receptacle side wall 116. In an exemplary embodiment, and as illustrated in FIG. 3, first and second ridge portions 120, 122 are unequal in length and are oriented at different angles with respect to receptacle side wall 116. More specifically, starting from a free end 124 of alarm terminal 112 located behind fuse receptacle side wall 116, upper ridge portion 120 extends into fuse receptacle 104 for a first distance at a first angle with respect to fuse receptacle side wall 116, and lower ridge portion 122 extends away from fuse receptacle 104 for a second distance at a second angle with respect to fuse receptacle side wall 116. The first distance of upper ridge portion 120 is greater than the second distance of lower ridge portion 122, and the angle between lower ridge portion and 122 and fuse receptacle side wall 116 is greater than the angle between upper ridge portion and fuse receptacle side wall 116. Thus, a pointed projecting ridge 114 is formed that extends into fuse receptacle 104 for engagement with a fuse alarm terminal, such as alarm terminal 82 (shown in FIG. 2).

Alarm terminal 112 further includes a first substantially linear portion 125 extending from lower ridge portion 122. Linear portion 125 extends substantially parallel to fuse receptacle side wall 116 and past a bottom 126 of fuse receptacle to an approximately 180° bend 128 located adjacent line side terminal contact 108. A second substantially linear portion 130 extends upwardly from bend 128 to a second bend 132 culminating in a first angled section 134 extending inwardly toward linear portion 130 and a second angled portion 136 extending outwardly from first angled portion 134 to alarm terminal free end 118 located exterior to housing 102. In one embodiment, second linear portion 130 extends for a lesser lineal distance than first linear portion 125, and angled portions 134, 136 are substantially equal in length and extend toward and away from, respectively, linear portions 125, 130 at approximately equal angles.

Housing contacts 106, 108 include respective clip portions 138, 140 including resilient fingers 142, 144 respectively for receiving and retaining fuse terminals 12, 16 (shown in FIGS. 1 and 2) when fuse terminals 12, 16 are inserted through openings 146, 148 in fuse receptacle bottom 126. Contacts 106, 108 each further include respective terminal portions 150, 152 for load side and line side electrical connection to external circuitry (not shown) in the end application of the fused disconnect switch. Each terminal portion 150, 152 each includes a threaded captive nut 154, 156, respectively, for establishing line side and load side electrical connections to housing 102.

Housing contacts 106, 108 in an exemplary embodiment are located beneath fuse receptacle bottom 126 to substantially prevent inadvertent contact with conductive portions of the contacts when a fuse, such as fuse assembly 60, is removed from housing assembly 100, and more specifically from fuse receptacle 104. It is contemplated, however, that housing contacts 106, 108 could be extended directly into fuse receptacle 104 without departing from the scope of the present invention.

Figure 4:
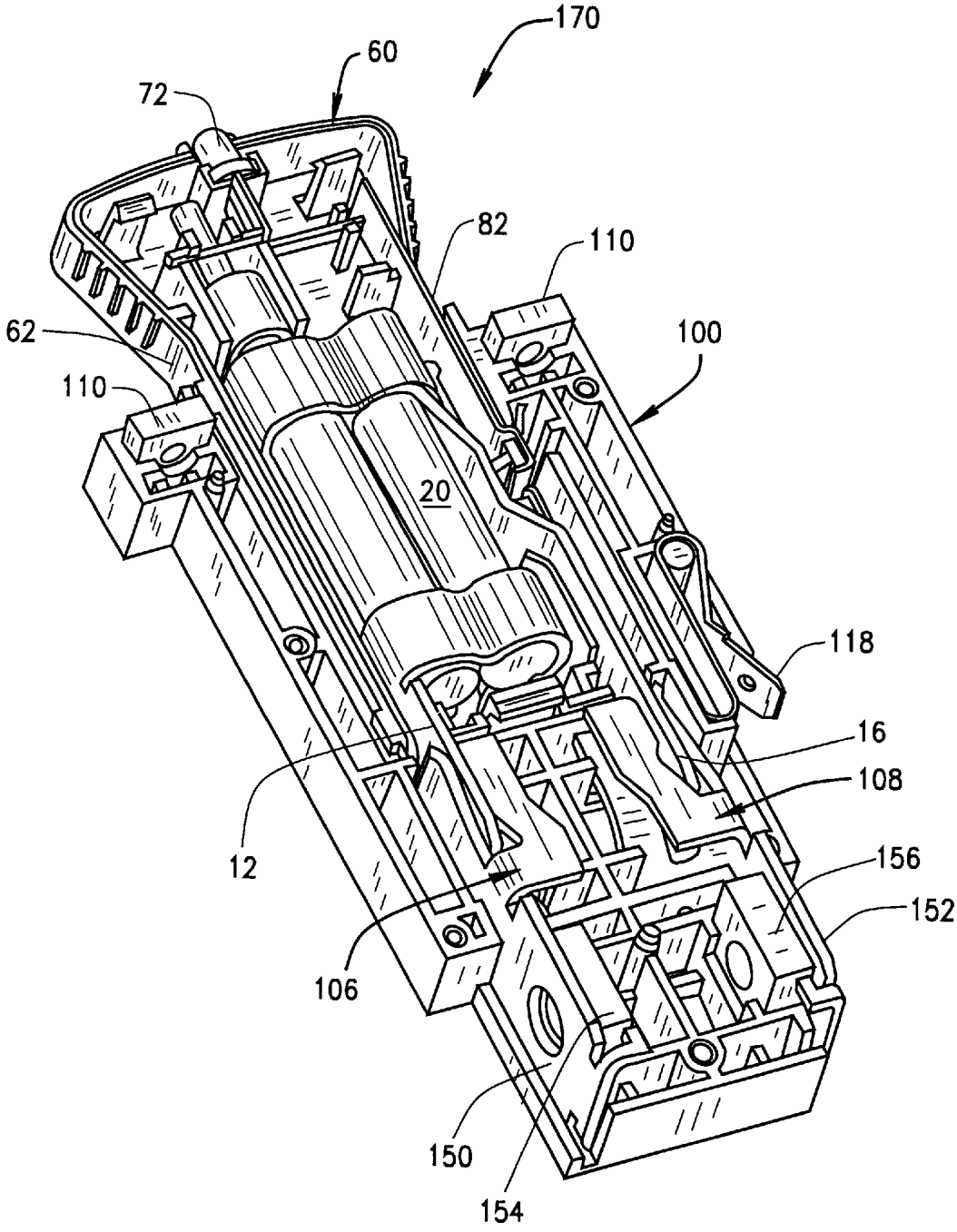
FIG. 4 is a perspective view of a fused disconnect switch including the fuse assembly shown in FIG. 2 and the switch housing shown in FIG. 3.

FIG. 4 is a perspective view of a fused disconnect switch 170 including fuse assembly 60 (shown in FIG. 2) connected to switch housing assembly 100 (shown in FIG. 3). Fuse assembly housing 62 is inserted into housing fuse receptacle 104 (shown in FIG. 3), and fuse terminal blades 12, 16 are received in switch housing line and load contacts 108, 106. Thus, when housing line contact terminal portion 152 is connected to an input bus bar (not shown), and further when housing load contact terminal portion 150 is connected to a load circuit or component (not shown), a fused electrical connection is provided through fuse assembly 60. By removing fuse assembly 60 from fuse receptacle 104 (shown in FIG. 3) and removing fuse terminal blades 12, 16 from switch housing line 108 and load 106 contacts, the circuit is opened between the line and load contacts 108, 106, thereby disconnecting and isolating load circuits and components associated with load side contact 106.

When primary fuse 20 is opened due to a fault current condition, a signal is sent to external equipment (not shown), such as a relay coil, via connection to alarm terminal end 118, thereby remotely directing attention to a particular location where an opened fuse is located. Local fuse state indication via illuminated LED 72 identifies the open fuse or fuses in the specified location. Thus, opened fuses may be efficiently located even when large numbers of fuses in various locations are employed.

Figure 5:
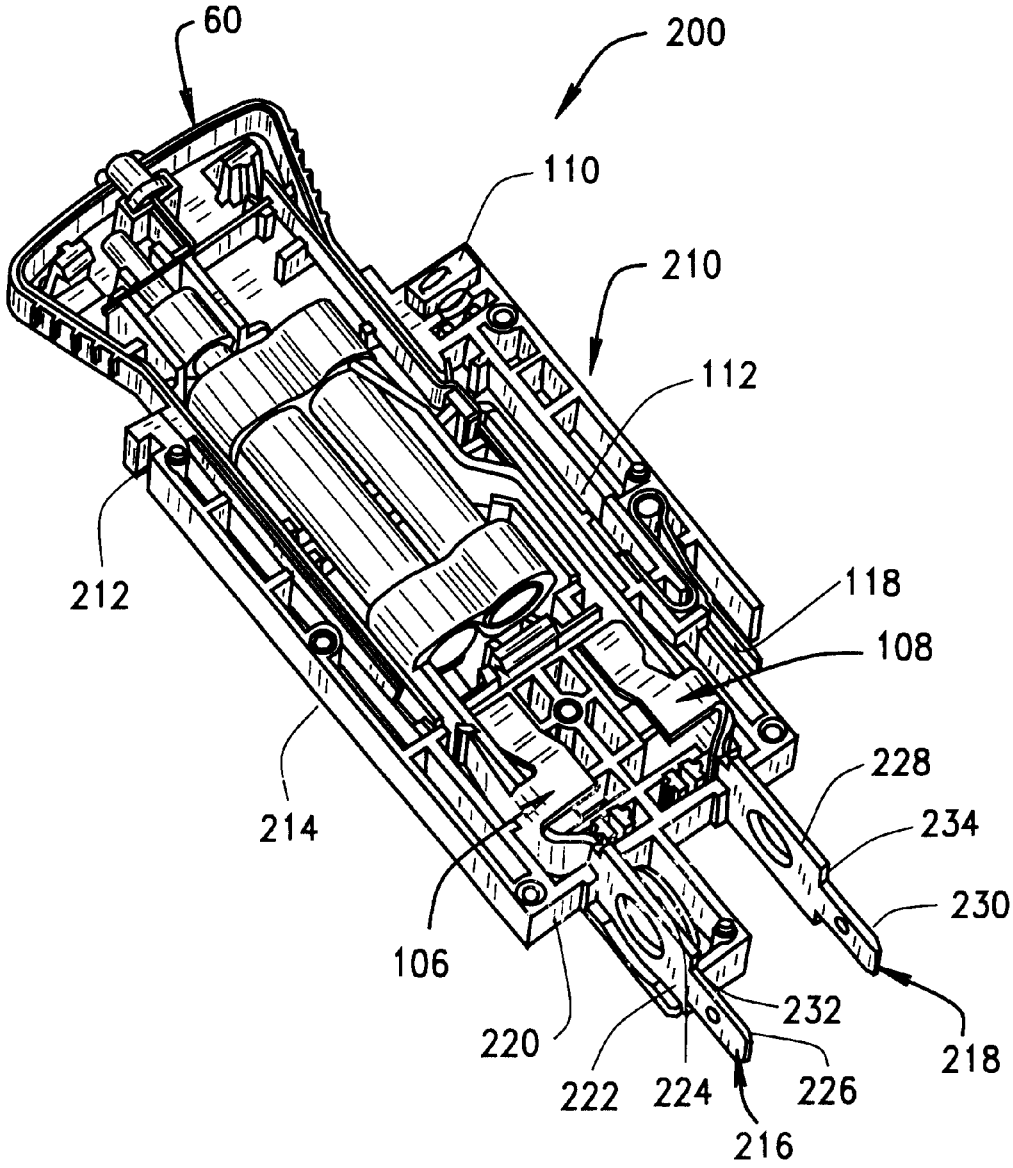
FIG. 5 is a perspective view of another embodiment of a fused disconnect switch.

FIG. 5 is a perspective view of another embodiment of a fused disconnect switch 200 employing fuse assembly 60 with another embodiment of a switch housing assembly 210. Switch housing assembly 210 is similar to switch housing assembly 100 (shown in FIG. 3) except as noted below, and like components with housing 100 are indicated with like reference characters.

Comparing FIGS. 4 and 5, switch housing assembly 210, unlike switch housing assembly 100, includes a groove 212 in an upper corner of a switch housing 214. Groove 212, in one embodiment, engages an edge (not shown) of a panel cutout (not shown) of for example, a telecommunications system to facilitate mounting of housing 214 to the panel. An opposite upper corner includes threaded nut 110 for mounting to the panel. Thus, housing 214 may be securely panel mounted with only one fastener through nut 110 when groove 212 is engaged to a portion of the panel. Field installation is accordingly simplified, and fused disconnect switch may be installed in approximately one half the time required of, for example, fused disconnect switch 170 (shown in FIG. 4) that employs two threaded nuts 110 for mounting the fused disconnect switch.

In addition, and further unlike housing 100, housing 214 includes terminal blades 216, 218 extending from a lower periphery 220 of switch housing 214. Load side terminal 216 includes an upper terminal portion 222 including a threaded captive nut 224 for secure connection to a cable terminal (not shown), and a lower portion 226 for plug-in connection to external circuitry (not shown in FIG. 5) in the end application of fused disconnect switch 200. Similarly, line side terminal 218 includes an upper portion 228 for a bus connection or connection with an external fastener (not shown in FIG. 5) and a lower portion 230 for plug in connection to external circuitry. Upper portions 222, 228 of respective terminal blades 216, 218 are each wider than respective lower portions 226, 230 both to facilitate connections with fasteners in upper portions 222, 228 and also to provide stops 232, 234 to prevent terminal blades 216, 218 from insertion into a mating connector (not shown) beyond a predetermined distance.

In yet another aspect, switch housing assembly 210, unlike switch housing assembly 170, includes a free end 118 of alarm terminal 112 extending from housing 214 in a substantially straight and parallel manner with respect to terminal portions 124, 130 (see FIG. 3 for comparison).

When a load side electrical connection is established with terminal blade 216 and a line side electrical connection is established with terminal blade 218, and further when alarm terminal 112 is coupled to external equipment (not shown in FIG. 5) fused disconnect switch 200 operates functionally as described above in relation to FIG. 4. Local and remote fuse state indication is facilitated in compact package, and by inserting or removing fuse assembly 60 from the switch housing fuse receptacle, line side equipment is effectively switched from load side equipment as desired.

In an exemplary embodiment, housing 214, unlike conventional fused disconnect switches is dimensioned for installation into a 1 $\mu$ (1.75 inch/44.5 mm) panel familiar to those in the art. A compact fused disconnect switch is therefore provided with desirable mounting features to facilitate installation into paneled systems, such as those in telecommunication systems, and reliable local and remote fuse state indication is provided with an easy to use, pull-out fuse assembly. Connections to bus inputs and common alarm buses are facilitated and quick connection, plug in terminals for quick and easy installation is provided. The size of the above-described housing also facilitates ganging of multiple switches on a common input bus in existing systems. Thus, at least for these reasons, a fused disconnect switch is provided for applications wherein conventional switches have been found inadequate, such as use in telecommunications systems.

While the invention has been described in terms of various specific embodiments, those skilled in the art will recognize that the invention can be practiced with modification within the spirit and scope of the claims.

What is claimed is:

1. A fused disconnect switch assembly comprising:

a switch housing assembly comprising a housing defining a fuse receptacle, first and second terminal contacts within said housing adjacent said fuse receptacle; and an alarm terminal extending from said fuse receptacle to an exterior of said housing; and a pull out fuse assembly comprising a housing, a line side terminal extending from said housing, a load side terminal extending from said housing, a primary fuse comprising first and second conductive end caps, said end caps coupled, respectively, to said line side terminal and said load side terminal, said first and second terminal contacts receiving said load side terminal and said line side terminal and establishing an electrical connection therebetween when said fuse assembly is inserted into said fuse receptacle, and wherein said line side terminal and said load side terminal extend substantially parallel to a longitudinal axis of said primary fuse, and a secondary fuse coupled to said line side and said load side terminal, said secondary fuse comprising a fuse indicator cap.

2. A fused disconnect switch assembly in accordance with claim 1 further comprising an upper fuse bracket and a lower fuse bracket, said primary fuse and said secondary fuse mounted in said upper fuse bracket and said lower fuse bracket.

3. A fused disconnect switch assembly in accordance with claim 1 wherein said secondary fuse comprises a longitudinal axis, said longitudinal axis of said secondary fuse substantially parallel to said longitudinal axis of said primary fuse.

4. A fused disconnect switch assembly in accordance with claim 1 wherein said fuse assembly further comprises an LED, said LED comprising a first lead, said first lead separated from said fuse indicator cap during normal operation of said fuse.

5. A fused disconnect switch assembly in accordance with claim 4, said fuse assembly further comprising a fuse alarm terminal, said LED comprising a second lead coupled to said alarm terminal.

6. A fused disconnect switch assembly in accordance with claim 5 wherein said fuse assembly housing comprises an opening therethrough, said fuse alarm terminal exposed through said opening, said alarm terminal of said switch housing assembly engaging said fuse alarm terminal when said fuse assembly is inserted into said fuse receptacle.

7. A fused disconnect switch assembly in accordance with claim 1, said fuse assembly comprising an open fuse indicator, and wherein said alarm terminal comprises a projecting ridge extending into said fuse receptacle, said alarm terminal in communication with said open fuse indicator in said fuse assembly when said fuse assembly is inserted into said fuse receptacle.

8. A fused disconnect switch assembly in accordance with claim 1 wherein said pull out fuse assembly comprises a first fuse bracket and said second fuse bracket receiving said primary fuse and said secondary fuse, said line side terminal and said load side terminal comprising terminal blades.

9. A fused disconnect switch assembly in accordance with claim 1, wherein said pull out fuse assembly comprises a first fuse bracket and said second fuse bracket, said primary fuse and said secondary fuse mounted in parallel between said first fuse bracket and said second fuse bracket.

10. A fused disconnect switch assembly in accordance with claim 1 wherein said switch housing assembly comprises at least one threaded nut.

11. A fused disconnect switch assembly in accordance with claim 1 wherein said switch housing assembly comprises a panel mounting groove and a threaded nut.

12. A fused disconnect switch assembly comprising:

a pull out fuse assembly comprising a housing, a primary fuse and a secondary fuse for fuse state indication, said primary fuse and said secondary fuse mounted in parallel between a first fuse bracket and a second fuse bracket, an LED visible through said housing, and an alarm terminal in communication with said LED; and a switch housing assembly comprising first and second contacts configured for establishing an electrical connection between said first and second fuse brackets; and a remote alarm terminal configured to engage said alarm terminal when said fuse assembly is connected to said switch housing.

13. A fused disconnect switch in accordance with claim 12 wherein said primary fuse comprises opposite end caps, said end caps coupled to said first fuse bracket and to said second fuse bracket.

14. A fused disconnect switch in accordance with claim 12 wherein said secondary fuse comprises a fuse indicator cap.

15. A fused disconnect switch in accordance with claim 14 wherein said LED comprises a first lead, said first lead separated from said fuse indicator cap during normal operation of said fuse.

16. A fused disconnect switch in accordance with claim 12 wherein said switch housing comprises at least one threaded nut.

17. A fused disconnect switch in accordance with claim 12 wherein said switch housing comprises at least one terminal extending from one of said first and second contacts, said at least one terminal comprising a threaded nut.

18. A fused disconnect switch in accordance with claim 12 wherein said switch housing comprises a panel mounting groove and a threaded nut.

* * * * *